US008552698B2

(12) United States Patent
Chow

(10) Patent No.: US 8,552,698 B2
(45) Date of Patent: Oct. 8, 2013

(54) HIGH VOLTAGE SHUNT-REGULATOR CIRCUIT WITH VOLTAGE-DEPENDENT RESISTOR

(75) Inventor: Melvin Kit Ho Chow, Singapore (SG)

(73) Assignee: International Rectifier Corporation, El Segundo, CA (US)

( * ) Notice: Subject to any disclaimer, the term of this patent is extended or adjusted under 35 U.S.C. 154(b) by 570 days.

(21) Appl. No.: 12/039,178

(22) Filed: Feb. 28, 2008

(65) Prior Publication Data

US 2008/0211476 A1 Sep. 4, 2008

Related U.S. Application Data

(60) Provisional application No. 60/892,569, filed on Mar. 2, 2007.

(51) Int. Cl.
*G05F 1/614* (2006.01)
*G05F 1/618* (2006.01)

(52) U.S. Cl.
USPC ..... 323/224; 323/226; 323/303; 323/312

(58) Field of Classification Search
USPC ..... 323/224, 226, 270, 303, 312, 908
See application file for complete search history.

(56) References Cited

U.S. PATENT DOCUMENTS

| | | | | |
|---|---|---|---|---|
| 3,648,153 | A * | 3/1972 | Graf | 323/313 |
| 4,686,449 | A * | 8/1987 | Jeffrey et al. | 323/231 |
| 4,716,356 | A * | 12/1987 | Vyne et al. | 323/312 |
| 4,736,126 | A * | 4/1988 | Susak | 327/430 |
| 5,424,663 | A * | 6/1995 | Wong | 327/65 |
| 5,519,313 | A * | 5/1996 | Wong et al. | 323/315 |
| 6,084,391 | A * | 7/2000 | Onodera | 323/315 |
| 6,157,049 | A * | 12/2000 | Mitlehner et al. | 257/77 |
| 6,225,797 | B1 * | 5/2001 | Willis et al. | 323/351 |
| 6,798,181 | B2 * | 9/2004 | Emmerik | 323/312 |
| 6,967,470 | B2 * | 11/2005 | Takabayashi | 323/224 |
| 2005/0275447 | A1 * | 12/2005 | Tsividis | 327/427 |

* cited by examiner

*Primary Examiner* — Adolf Berhane
*Assistant Examiner* — Fred E Finch, III
(74) *Attorney, Agent, or Firm* — Farjami & Farjami LLP

(57) ABSTRACT

A voltage regulator circuit comprising a first circuit functioning as a voltage dependent resistor, the first circuit having an input coupled to a voltage source and an output and having a resistance dependent on the voltage applied across the circuit by the voltage source such that the resistance increases as the applied voltage increases; and a regulator coupled to the output of the first circuit for providing a regulated output voltage.

19 Claims, 5 Drawing Sheets

HIGH VOLTAGE SHUNT-REGULATOR CIRCUIT WITH VOLTAGE-DEPENDENT RESISTOR

CROSS-REFERENCE TO RELATED APPLICATION

The present application claims the benefit and priority of U.S. Provisional Application Ser. No. 60/892,569 filed Mar. 2, 2007 entitled HIGH VOLTAGE SHUNT-REGULATOR CIRCUIT WITH VOLTAGE DEPENDENT RESISTOR, the entire disclosure of which is hereby incorporated by reference.

FIELD OF THE INVENTION

This invention relates to Integrated Circuits (ICs) and more particularly to a shunt regulator to regulate the power supply of integrated circuits, for example, active ORing ICs.

BACKGROUND OF THE INVENTION

Shunt regulator circuits are used in ICs, for example, in the active ORing IC part number IR5001 made by International Rectifier Corporation of El Segundo, Calif.

FIG. 1 is a diagram of a circuit employing the IR5001 IC. The ICs actively OR two 48 volt power supplies by controlling the power FETs. A shunt-regulator (FIG. 2) is used to draw a variable current through a resistor R that is connected at one terminal to the line voltage VLINE, so as to maintain a regulated voltage VCC at the other terminal of the resistor. This terminal of the resistor thus serves as the regulated power-supply of the IC. It is also the output of the shunt-regulator and is labeled as the VCC pin of the IC.

In the previous IC (IR5001), there is a maximum limit on the resistor value so that the current drawn from the minimum line voltage is able to operate the IC, otherwise, a resistor external to the IC has to be used. However, at maximum line voltage, the power-dissipation of an internal resistor generates thermal dissipation that is unacceptable to the present IC package. Thermal runaway will reduce the reliability of High-voltage ICs.

Previous method of using a fixed-value internal resistor for shunt regulation, as in IR5001, is not efficient. The solution in IR5001 requires an external resistor to be chosen for different line voltage if the fixed-value internal resistor is not appropriate. In addition, the reliability of the previous method is inadequate when the resistor is subjected to voltages above the device's operational rating.

Known prior art includes:

1. U.S. Pat. No. 3,535,613: "Compensated Solid State Voltage Regulator Circuit Including Transistors and Zener Diode."
2. U.S. Pat. No. 3,648,153: "Reference Voltage Source."
3. U.S. Pat. No. 3,851,241: "Temperature Dependent Voltage Reference Circuit."
4. U.S. Pat. No. 4,103,219: "Shunt Voltage Regulator."
5. IR5001 data sheet and application of the internal shunt-regulator.

In addition to power-dissipation and thermal reliability issues, the invention provides a novel solution to high-voltage biasing, despite the limitation in International Rectifier's Gen 5 technology for 22V-rated devices. The resistors in Gen 5 are rated at 22V and would not be able to operate reliably at a line voltage of 100V.

The Gen 5 technology referred to above refers to the technology for the manufacture of high voltage PMOS devices as at least partly disclosed in the following patents:

1. U.S. Pat. No. 5,861,657: "Graded Concentration Epitaxial Substrate for semiconductor device having resurf diffusion.
2. U.S. Pat. No. 5,686,754: "Polysilicon Field Ring Structure for Power IC."
3. U.S. Pat. No. 5,801,418: "High Voltage Power Integrated Circuit with Level Shift Operation and Without Metal Crossover."
4. U.S. Pat. No. 5,801,431: "MOSgated Semiconductor Device with Source Metal Covering the Active Gate."

SUMMARY OF THE INVENTION

The basic concept of the invention is a Voltage-dependent-resistor (VDR) that increases in resistance at an increasing rate when increasing voltage is applied across it. Thus, the current dissipation is controlled in such a way that it will saturate high-voltage without significant increase. In other words, the VDR behaves as a resistor at low-voltage, but behaves as a current source at high-voltage.

The novelty of the invention lies in the structure of the VDR, which is derived from a parasitic P-JFET inside the HV-PMOS device in Gen 5, as well as the in a novel high-voltage biasing circuit for the HV-PMOS.

DESCRIPTION AND DRAWINGS OF THE INVENTION

Figure 1:
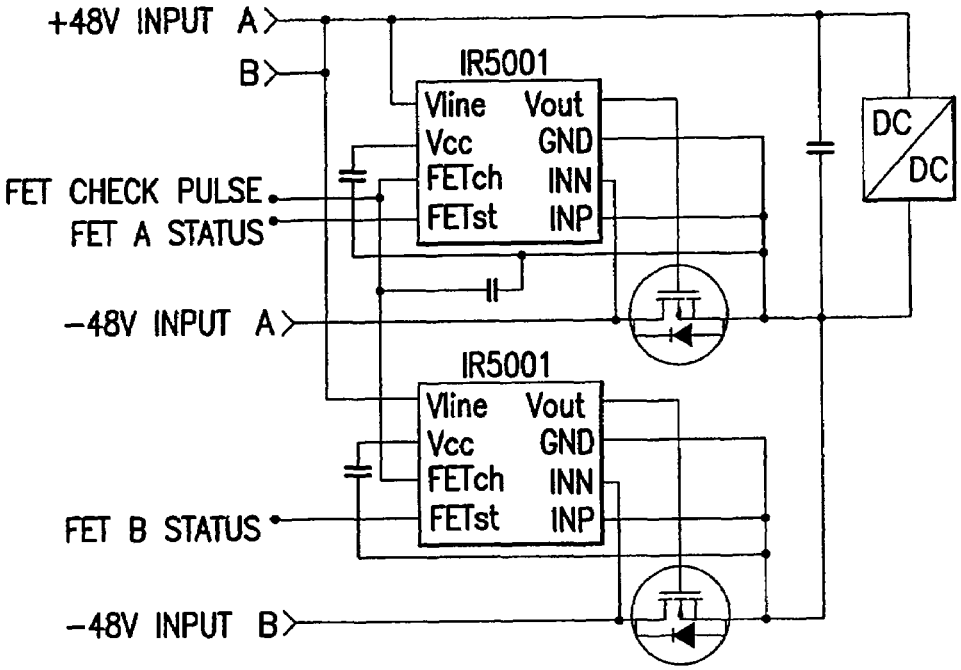
FIG. 1 PRIOR ART
FIG. 1 shows a prior art power supply ORing circuit.
Figure 2:
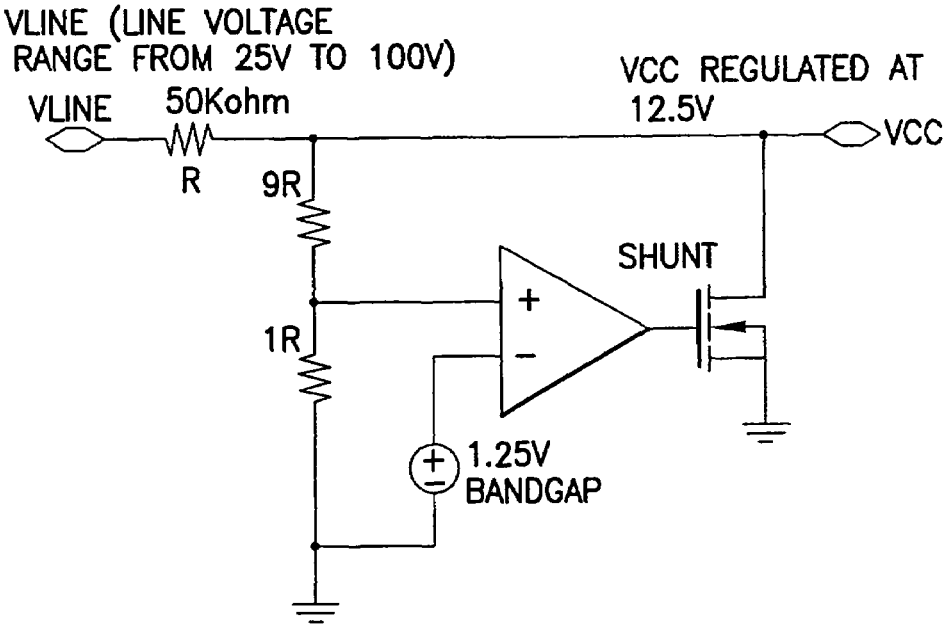
FIG. 2 PRIOR ART
FIG. 2 shows the shunt regulator used in the ICs of FIG. 1.
Figure 3A:
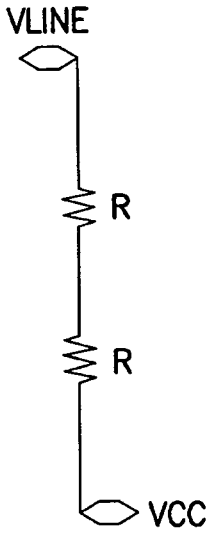
FIGS. 3A, B and C show the genesis of the circuit according to the invention.
Figure 3B:
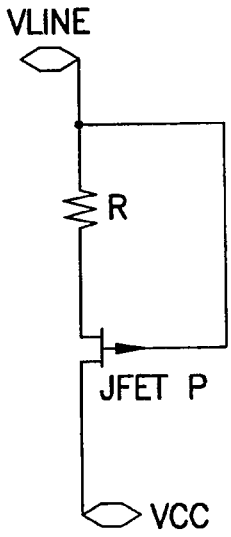
Figure 3C:
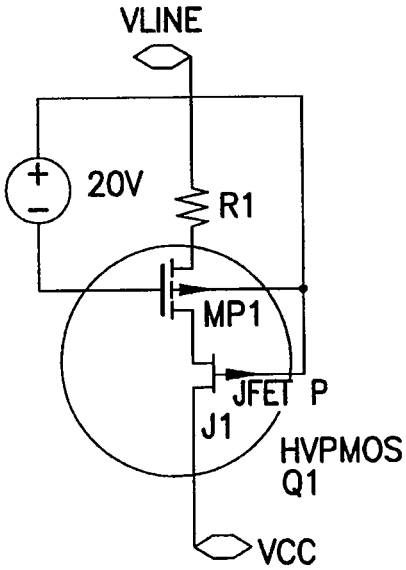

With reference to FIG. 3C, the VDR core consists of HV-PMOS Q1 and resistor R1 shown on the R1 shown in the circuit (FIG. 4), with PMOS MP1 and P-JFET J1 internal to Q1. The gate of J1, connected to the bulk (substrate) of MP1, is accessible from the HV-PMOS and is connected to the line voltage. Thus, an increasing line voltage will activate the P-JFET and eventually pinch-off its channel and the current flowing through the channel will saturate. The gate of MP1 (of HVMOS Q1) is biased at a fixed gate-source voltage that is equivalent to the voltage drop across a series stack of zener-diodes (DZ1, DZ2, DZ3 and DZ4). This gate bias (node nz) keeps MP1 in triode (linear) region of operation, and therefore MP1 operates as a closed switch with small resistance.

Figure 4:
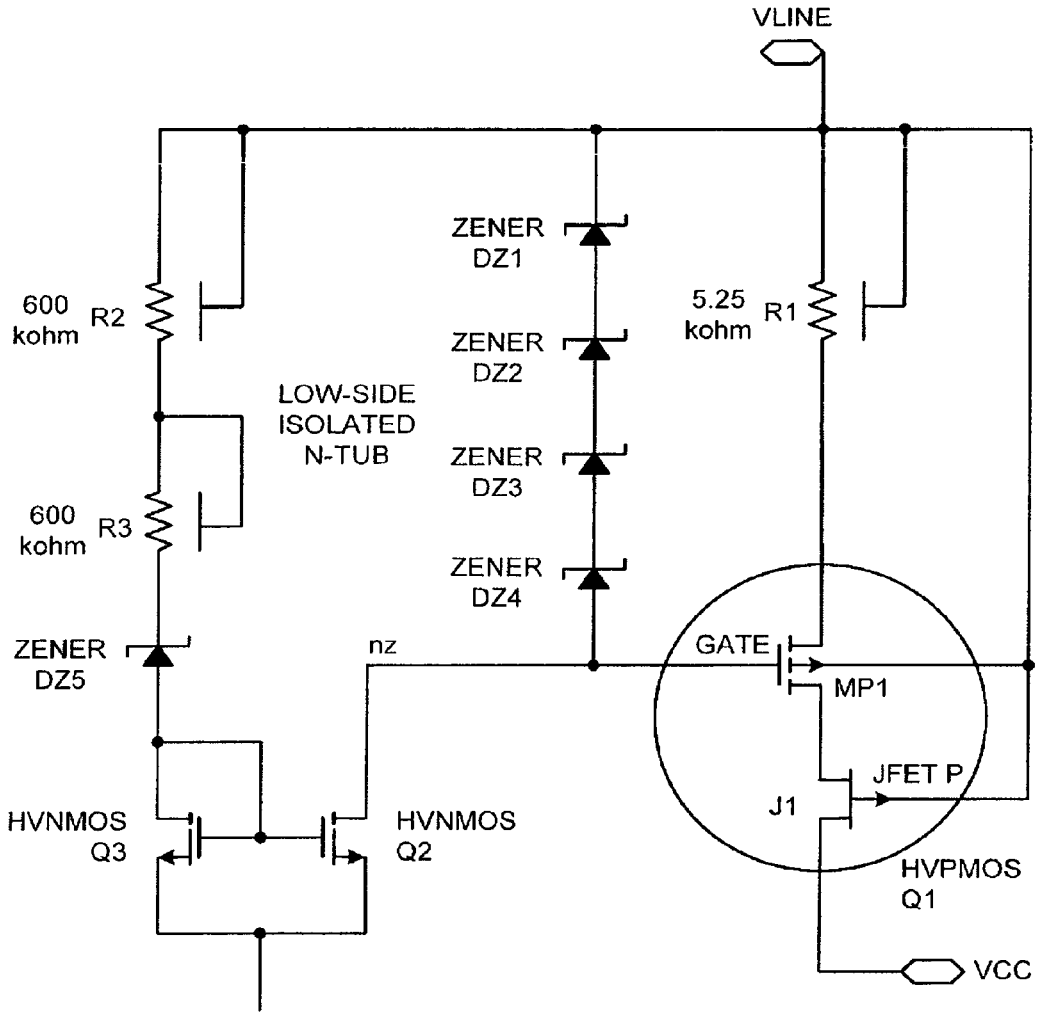
FIG. 4 shows details of the VDR FIG. 3C.

The high-voltage bias circuit is shown in FIG. 4, and includes zener-diodes—DZ1, DZ2, DZ3, DZ4 and DZ5, resistors R2 and R3, and mirror circuit comprising HVNMOS—Q2 and Q3. The HVNMOS Q2 serves the purpose of a current source to bias DZ1, DZ2, DZ3 and DZ4. This biasing current is mirrored from Q3 which is a diode-connected HVNMOS. For this reason it is not necessary for Q3 to be a HVNMOS but is preferable for the purpose of having a matching device to Q2. The zener-diode DZ5 is used for the purpose of reducing the voltage stress across resistor R2 and R3. The resistors R2 and R3 are equal in value and are connected in series for the purpose of reducing the voltage stress between the resistors and the N-tubs containing the resistors. Each resistor resides in separate N-tubs: R3 is in an isolated N-tub on the low-side and R2 is in the high-side N-tub together with DZ1, DZ2, DZ3, DZ4, Q1 and R1.

Figure 5:
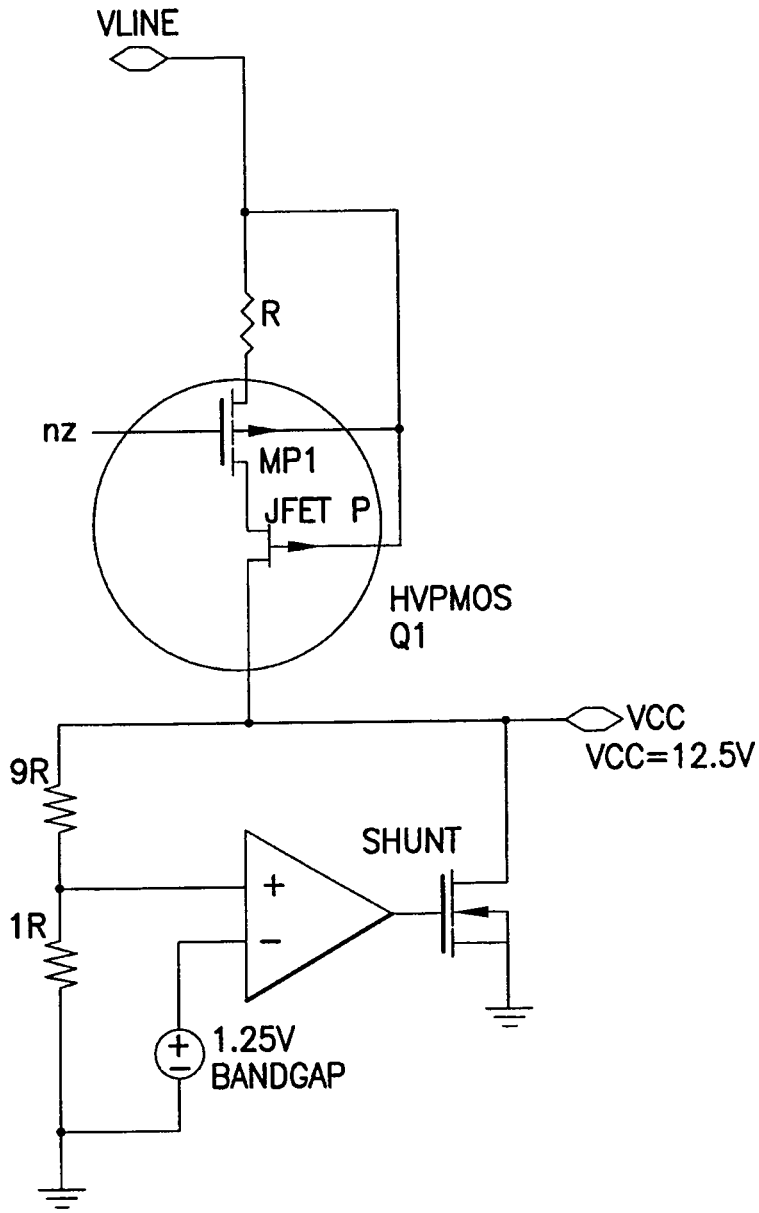
FIG. 5 shows the VDR and shunt regulator.

FIG. 5 shows the VDR of FIG. 4 with the shunt regulator.

Figure 6:
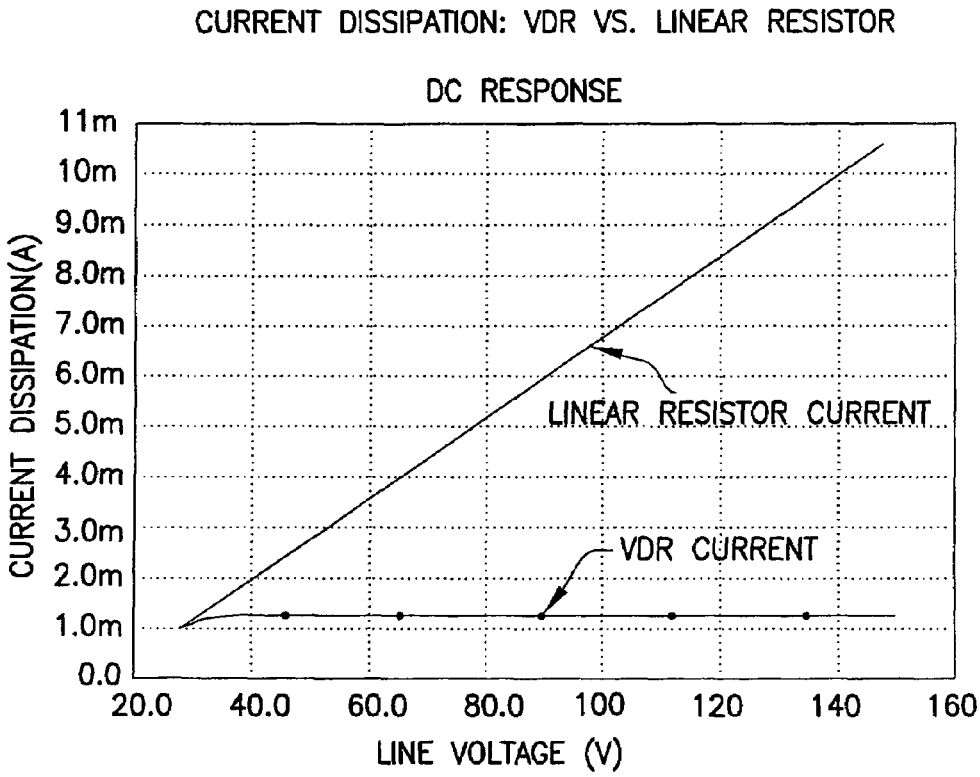
FIG. 6 compares the invention and the prior art.

The invention has the following advantages:

1. Low and controlled power dissipation at higher line voltages. FIG. 6 illustrates the difference in current dissipation for a prior art linear resistor and for a VDR according to the invention.

2. Integrated, high-voltage power-supply regulation that does not require any external components. The VDR circuitry is able to withstand voltage up to 150V at the VLINE pin. Thus, improved reliability is realized without the usage of external components.

Although the present invention has been described in relation to particular embodiments thereof, many other variations and modifications and other uses will become apparent to those skilled in the art. It is preferred, therefore, that the present invention be limited not by the specific disclosure herein.

What is claimed is:

1. A voltage regulator circuit comprising:

a first circuit functioning as a voltage dependent resistor, the first circuit having an input coupled to a voltage source and an output and having a first circuit resistance dependent on an applied voltage applied across the first circuit by the voltage source such that the first circuit resistance increases as the applied voltage increases; and a regulator coupled to the output of the first circuit for providing a regulated output voltage;

the first circuit comprising a MOS transistor and a series JFET, wherein the voltage source is connected to both the MOS transistor and the series JFET at a single node, and wherein the series JFET has its main terminals connected in series with main terminals of the MOS transistor.

2. The voltage regulator circuit of claim 1, wherein the first circuit resistance increases at an increasing rate as the applied voltage increases, thereby causing a first circuit current through the first circuit to saturate.

3. The voltage regulator circuit of claim 2, wherein the first circuit comprises the MOS transistor and the series JFET functioning as the voltage dependent resistor, the series JFET having a conduction channel that pinches off with increasing voltage of the voltage source such that a channel of the series JFET will saturate at a certain applied voltage.

4. The voltage regulator circuit of claim 3, wherein the series JFET is an internal JFET of the MOS transistor.

5. The voltage regulator circuit of claim 4, wherein the MOS transistor is a PMOS transistor and the series JFET is a P-JFET.

6. The voltage regulator circuit of claim 3, wherein the output of the first circuit comprises a main terminal of said series JFET, said main terminal of said JFET being coupled to said regulator.

7. The voltage regulator circuit of claim 1, wherein said MOS transistor has a gate coupled to a biasing circuit for biasing the MOS transistor in a triode region of operation.

8. The voltage regulator circuit of claim 7, wherein the biasing circuit comprises at least one zener diode.

9. The voltage regulator circuit of claim 8, wherein the biasing circuit comprises a current source circuit coupled to said at least one zener diode for providing a biasing current to said gate of said MOS transistor.

10. The voltage regulator circuit of claim 9, wherein said current source circuit comprises a current mirror circuit defining a reference current in a further resistance disposed between the voltage source and the current mirror circuit.

11. The voltage regulator circuit of claim 10, wherein said further resistance comprises a first resistance and a second resistance.

12. The voltage regulator circuit of claim 11, further comprising a further zener diode in series with said first and second resistances.

13. The voltage regulator circuit of claim 10, wherein said at least one zener diode is in parallel connection with said further resistance in series with said current mirror circuit.

14. The voltage regulator circuit of claim 9, wherein said at least one zener diode comprises a stack of series-connected zener diodes.

15. The voltage regulator circuit of claim 1, wherein said regulator comprises a shunt regulator.

16. The voltage regulator circuit of claim 1, wherein a substrate of the MOS transistor is coupled to the voltage source, a gate of the series JFET being coupled to the substrate.

17. The voltage regulator circuit of claim 1, wherein the series JFET has a gate coupled to the voltage source, and wherein the MOS transistor is connected in series with a core resistance.

18. A voltage regulator circuit comprising:

a first circuit functioning as a voltage dependent resistor, the first circuit having an input coupled to a voltage source and an output and having a first circuit resistance dependent on an applied voltage applied across the first circuit by the voltage source such that the first circuit resistance increases as the applied voltage increases; and a regulator coupled to the output of the first circuit for providing a regulated output voltage;

the first circuit comprising a MOS transistor and a series JFET functioning as the voltage dependent resistor, wherein the series JFET is an internal JFET of the MOS transistor.

19. A voltage regulator circuit comprising:

a first circuit functioning as a voltage dependent resistor, the first circuit having an input coupled to a voltage source and an output and having a first circuit resistance dependent on an applied voltage applied across the first circuit by the voltage source such that the first circuit resistance increases as the applied voltage increases; and a regulator coupled to the output of the first circuit for providing a regulated output voltage;

the first circuit comprising a MOS transistor and a series JFET functioning as the voltage dependent resistor, wherein said MOS transistor has a gate coupled to a biasing circuit for biasing the MOS transistor in a triode region of operation.

* * * * *